US010109935B2

(12) United States Patent
Kondo et al.

(10) Patent No.: US 10,109,935 B2
(45) Date of Patent: Oct. 23, 2018

(54) L-TYPE INNER TERMINAL, T-TYPE COAXIAL CONNECTOR INCLUDING THE L-TYPE INNER TERMINAL, AND METHOD FOR PRODUCING THE L-TYPE COAXIAL CONNECTOR

(71) Applicant: Hosiden Corporation, Yao-shi, Osaka (JP)

(72) Inventors: Hayato Kondo, Yao (JP); Daisuke Sasaki, Yao (JP)

(73) Assignee: HOSIDEN CORPORATION, Yao-Shi (JP)

( * ) Notice: Subject to any disclaimer, the term of this patent is extended or adjusted under 35 U.S.C. 154(b) by 0 days.

(21) Appl. No.: 15/927,590

(22) Filed: Mar. 21, 2018

(65) Prior Publication Data

US 2018/0277966 A1 Sep. 27, 2018

(30) Foreign Application Priority Data

Mar. 23, 2017 (JP) ..... 2017-057762

(51) Int. Cl.

| | |
|---|---|
| ***H01R 11/22*** | (2006.01) |
| ***H01R 9/05*** | (2006.01) |
| ***H01R 24/54*** | (2011.01) |
| ***H01R 13/20*** | (2006.01) |
| *H01R 103/00* | (2006.01) |

(52) U.S. Cl.

CPC ..... *H01R 9/0518* (2013.01); *H01R 13/20* (2013.01); *H01R 24/54* (2013.01); *H01R 2103/00* (2013.01)

(58) Field of Classification Search

CPC ... H01R 13/113; H01R 13/442; H01R 13/111; H01R 13/187

USPC ..... 439/852, 862, 851, 816, 682, 188

See application file for complete search history.

(56) References Cited

U.S. PATENT DOCUMENTS

| | | | | |
|---|---|---|---|---|
| 3,711,942 A * | 1/1973 | Reynolds | ..... | G01R 31/021 29/407.05 |
| 9,755,324 B2 * | 9/2017 | Kondo | ..... | H01R 4/16 |
| 10,008,787 B2 * | 6/2018 | Kondo | ..... | H01R 4/184 |

FOREIGN PATENT DOCUMENTS

| | | |
|---|---|---|
| JP | 5-31827 | 8/1993 |

* cited by examiner

*Primary Examiner* — Phuong Chi T Nguyen

(74) *Attorney, Agent, or Firm* — Rankin, Hill & Clark LLP

(57) ABSTRACT

An L-type inner terminal in which the increase of the impedance of a connecting portion can be suppressed, an L-type coaxial connector including the L-type inner terminal, and a method for producing the L-type coaxial connector are provided. In the L-type inner terminal, the main portion and the crimping portion are placed inside an L-shaped bent part of the connecting portion. The main portion and crimping portion, which have a low impedance, are proximal to the connecting portion, and therefore the increase of the impedance of the connecting portion can be suppressed by using the main portion and crimping portion, which are possessed by the L-type inner terminal itself.

14 Claims, 15 Drawing Sheets

L-TYPE INNER TERMINAL, T-TYPE COAXIAL CONNECTOR INCLUDING THE L-TYPE INNER TERMINAL, AND METHOD FOR PRODUCING THE L-TYPE COAXIAL CONNECTOR

BACKGROUND OF THE INVENTION (1) Field of the Invention

The present invention relates to: an L-type inner terminal having a tubular main portion which is to be contacted with a counter inner terminal, a crimping portion in which a crimp piece for crimping an inner conductor of a coaxial cable is disposed, and a connecting portion configured by a strip-shaped piece that is bent into an L-like shape which connects between the main portion and the crimping portion in a state where the elongating direction of the main portion is perpendicular to that of the crimping portion; an L-type coaxial connector including the L-type inner terminal; and a method for producing the L-type coaxial connector.

(2) Description of Related Art

An L-type inner terminal of this kind is produced by pressing an electrically conductive metal thin plate. In such an L-type inner terminal, usually, a connecting portion is formed by L-bending a strip-shaped piece of which the width is sufficiently smaller than the outer diameter of a main portion, which straight elongates, and which is in a developed state, while placing the main portion and a wiring connecting portion in the outside (for example, see Patent Literature 1). Since the wiring connecting portion is placed together with the main portion outside the L-shaped bent part of the connecting portion, a wiring work can be easily performed. Usually, the wiring is performed by clamping and crimping a crimping piece disposed in the wiring connecting portion. The crimping piece is easily clamped outside the L-shaped bent part.

PRIOR ART LITERATURE

Patent Literature

Patent Literature 1 Japanese Utility Model Publication No. 5-31827

SUMMARY OF THE INVENTION

Problem to be Solved by the Invention

An L-type inner terminal of this kind has a problem in that, in accordance with reduction of the surface area in the connecting portion, the impedance of the connecting portion is increased.

It is an object of the invention to provide an L-type inner terminal in which the increase of the impedance of a connecting portion can be suppressed, an L-type coaxial connector including the L-type inner terminal, and a method for producing the L-type coaxial connector.

Means for Solving the Problem

The first aspect of the present invention is an L-type inner terminal having: a tubular main portion which is to be contacted with a counter inner terminal; a crimping portion in which a crimp piece for crimping an inner conductor of a coaxial cable is disposed; and a connecting portion configured by a strip-shaped piece that is bent into an L-like shape which connects between the main portion and the crimping portion in a state where an elongating direction of the main portion is perpendicular to an elongating direction of the crimping portion, wherein the main portion and the crimping portion are placed inside an L-shaped bent part of the connecting portion.

According to the L-type inner terminal described in the first aspect mentioned above, the main portion and crimping portion which have a low impedance are proximal to the connecting portion, and therefore the increase of the impedance of the connecting portion can be suppressed by using the main portion and crimping portion which are possessed by the L-type inner terminal itself.

The second aspect of the present invention is the L-type inner terminal of the first aspect mentioned above, wherein the connecting portion comprises: a 90-degree arcuate bent part; first and second planar parts which straight elongate from ends of the bent part, respectively; a first connecting part which connects between the first planar part and the main portion; and a second connecting part which connects between the second planar part and the crimping portion, and at least the bent part, the first planar part, and the second planar part have a width dimension which is equal to or larger than an outer diameter dimension of the main portion.

According to the L-type inner terminal described in the second aspect mentioned above, the surface area ratio of the connecting portion which is opposed to an outer terminal that is located in the periphery of the L-type inner terminal is increased, and therefore the increase of the impedance in the connecting portion can be further suppressed.

The third aspect of the present invention is an L-type coaxial connector which is to be attached to a terminal of a coaxial cable, and in which a fitting direction with respect to a counter connector is perpendicular to an axial direction of the coaxial cable, wherein the L-type coaxial connector comprises: the L-type inner terminal of the first or second aspect above; a dielectric member that has a terminal attaching part to which the L-type inner terminal is attachable from a rear side toward a front side, and that surrounds and holds the L-type inner terminal; an outer terminal which has a tubular part projected in a direction in which the L-type coaxial connector is fitted to the counter connector, to be fitted with a counter outer terminal, which further has a contact piece part projected in the axial direction of the coaxial cable to overlap with an outer conductor of the coaxial cable, in which the dielectric member is attached from the rear side toward the front side, and which surrounds and holds the dielectric member; and a tubular crimp member that is clamp-fixed to an overlapping part between the contact piece part of the outer terminal and the outer conductor of the coaxial cable.

The fourth aspect of the present invention is the L-type coaxial connector of the third aspect mentioned above, wherein the outer terminal comprises a cover that is separately opposed to the second planar part of the L-type inner terminal in a state where the cover covers an opening part which is rearward disposed in order to allow the dielectric member to be attached to an interior of the outer terminal, the dielectric member comprises a spacer that is sandwiched between the dielectric member and the cover of the outer terminal in a state where an opening part that is rearward disposed in order to attach the L-type inner terminal to the terminal attaching part is covered, and impedance matching is performed by a distance between the cover of the outer terminal and the second planar part of the L-type inner terminal, and a dielectric constant of the spacer of the dielectric member.

The fifth aspect of the present invention is the L-type coaxial connector of the third or fourth aspect mentioned above, wherein the cover of the outer terminal has: a second contact piece part that is projected from one end of the cover in the axial direction of the coaxial cable to overlap with the outer conductor of the coaxial cable; and an engaging piece that is projected from another end of the cover along the axial direction of the coaxial cable to be engaged with an engaging hole disposed in a side wall of the outer terminal, and is electrically connected and physically coupled to the outer terminal by a clamping part of the crimp member and the engaging hole.

The sixth aspect of the present invention is a method for producing the L-type coaxial connector according to any one of the third to fifth aspects mentioned above, wherein the method comprises: an inner terminal connecting step of, in a developed state where the connecting portion of the L-type inner terminal has not yet been L-bent, and straight elongates, clamping the crimp piece of the L-type inner terminal to crimpingly connect the crimp piece to the inner conductor of the coaxial cable; and an inner terminal L-bending step of applying L-bending to the connecting portion in a developed state while the main portion of the L-type inner terminal, and the crimping portion which is crimped to the inner conductor of the coaxial cable in the inner terminal connecting step are placed inside.

Effects of the Invention

According to the invention, it is possible to provide an L-type inner terminal in which the increase of the impedance of a connecting portion can be suppressed, an L-type coaxial connector including the L-type inner terminal, and a method for producing the L-type coaxial connector.

BRIEF DESCRIPTION OF THE DRAWINGS

FIG. 1A is a view as seen in the axial direction of a coaxial cable, and FIG. 1B is a perspective view.

DETAILED DESCRIPTION OF PREFERRED EMBODIMENTS

Hereinafter, an embodiment of the invention will be described with reference to the drawings.

Figure 1B:
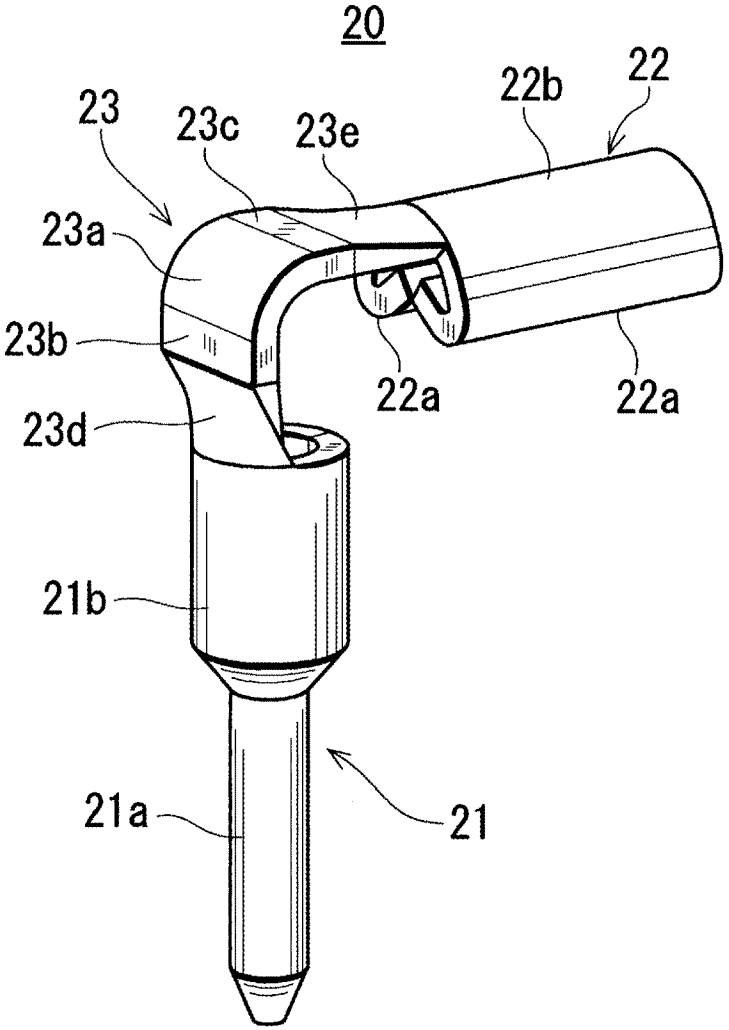
FIGS. 1A and 1B are views showing an L-type inner terminal of an embodiment.
Figure 1A:
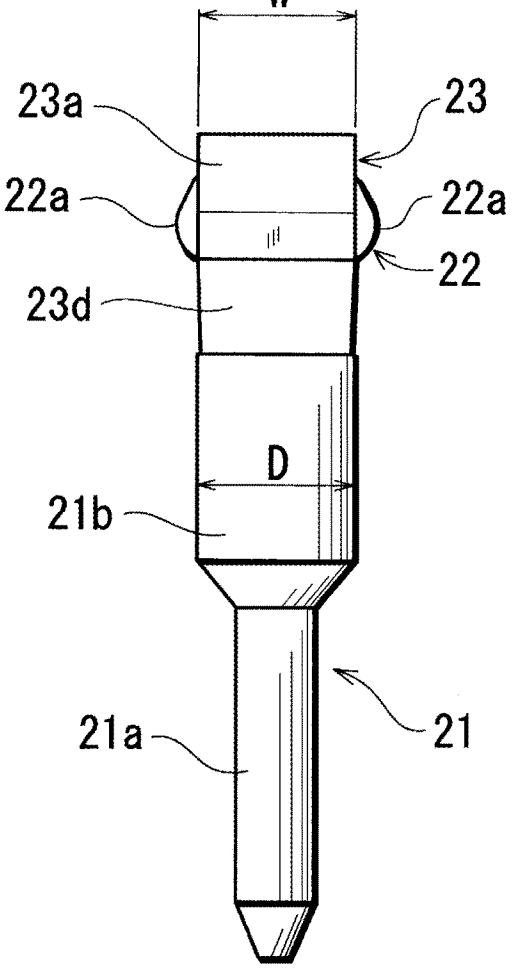
Figure 2:
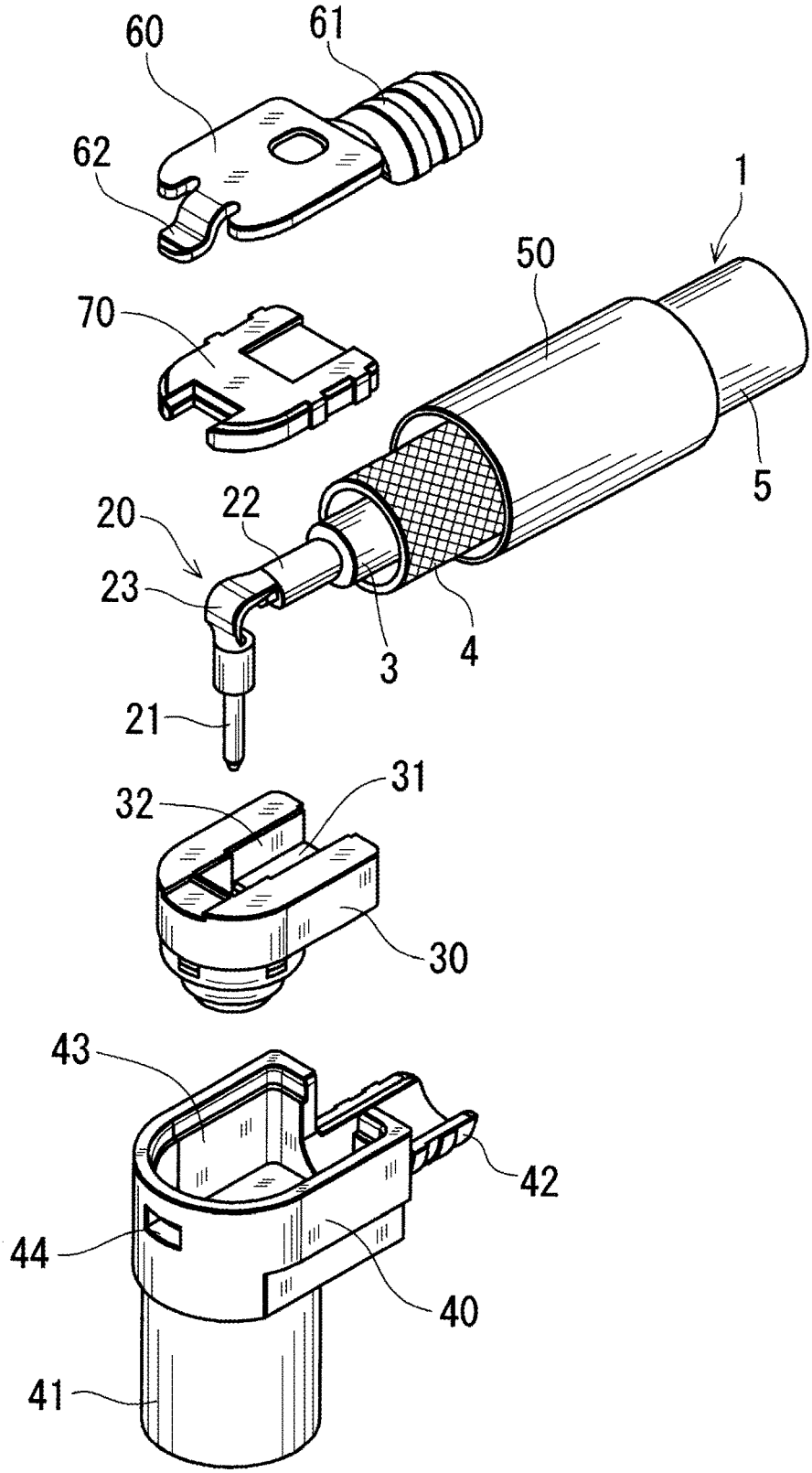
FIG. 2 is an exploded perspective view of an L-type coaxial connector of the embodiment.
Figure 3:
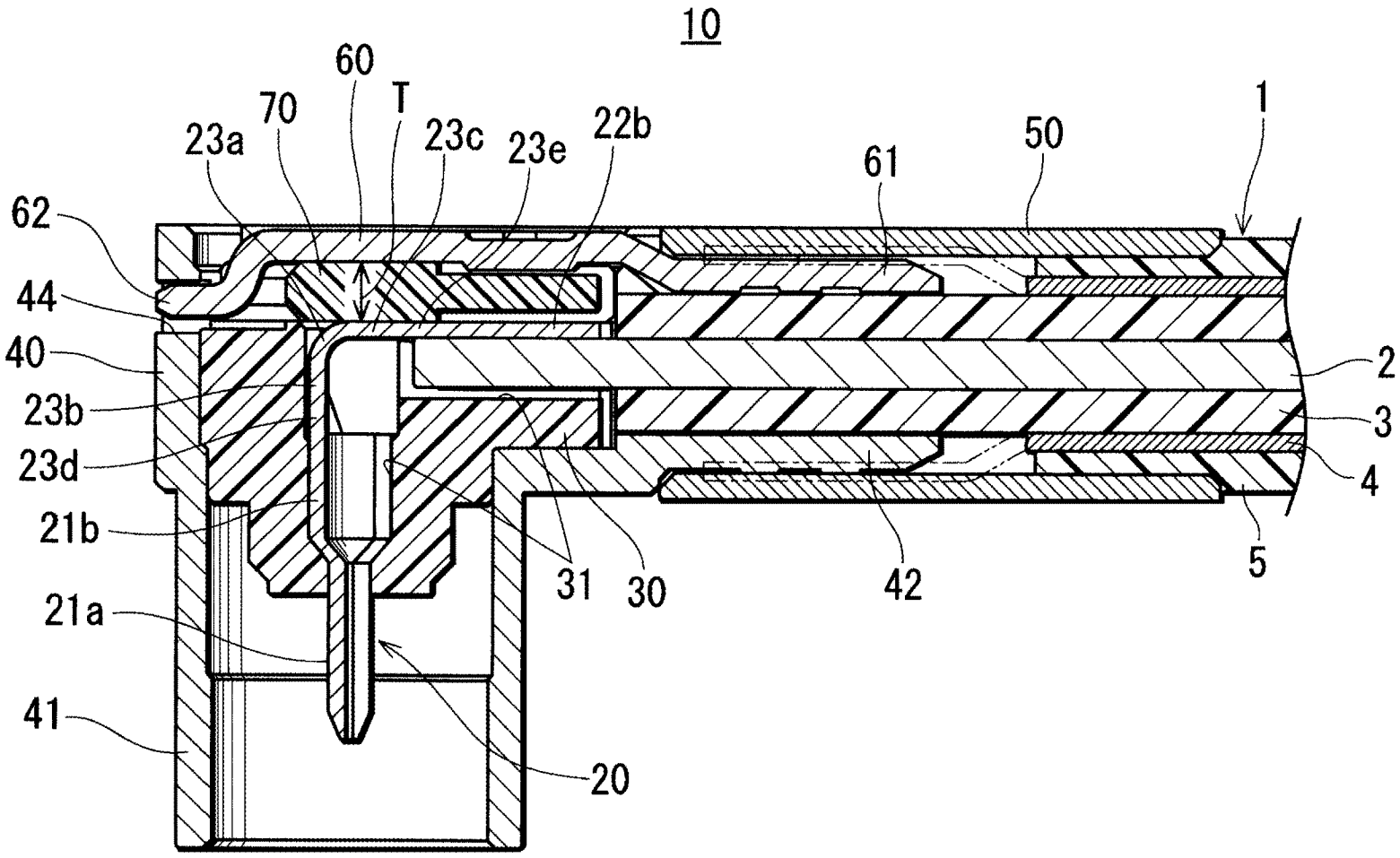
FIG. 3 is a sectional view of the L-type coaxial connector of the embodiment.

An L-type inner terminal 20 shown in FIGS. 1A and 1B is one component constituting an L-type coaxial connector 10 shown in FIGS. 2 and 3. The L-type coaxial connector 10 is a connector which is to be attached to a terminal of a coaxial cable 1, and in which the fitting direction with respect to a counter connector that is not shown is perpendicular to the axial direction of the coaxial cable 1. The following description will be made assuming that the side of the fitting between the L-type coaxial connector 10 and the counter connector is "front," and the opposite side is "rear."

As shown in FIGS. 2 and 3, the coaxial cable 1 has: a core wire 2 which is an inner conductor; an inner coat 3 which is an insulator covering the outer circumference of the core wire 2; a braid 4 which is an outer conductor covering the outer circumference of the insulator 3; and an outer coat 5 which is an insulator covering the outer circumference of the braid 4. The core wire 2 transmits a high-frequency signal, and the braid 4 blocks electromagnetic waves. In a terminal of the coaxial cable 1, the outer coat 5 is peeled off to expose the braid 4, and also the inner coat 3 is peeled off to expose the core wire 2. In this state, the terminal is connected to the L-type coaxial connector 10.

As shown in FIGS. 1A and 1B, the L-type inner terminal 20 has a main portion 21, a crimping portion 22, and a connecting portion 23. The L-type inner terminal 20 is formed by pressing an electrically conductive metal thin plate.

The main portion 21 is a contact portion with respect to a counter inner terminal, and formed into a tubular shape. The main portion 21 has a tip end part 21*a* and a basal part 21*b*. The tip end part 21*a* is formed into a pin-like shape. The basal part 21*b* which is continuous to the tip end part 21*a* is formed into a cylindrical shape which is larger in diameter than the tip end part 21*a*.

Before connection to the core wire 2 of the coaxial cable 1, the crimping portion 22 is formed so as to have a U-like sectional shape, and has a pair of crimp pieces 22*a* that form the lateral sides of the U-like shape, respectively, and a basal part 22*b* that forms the bottom side of the U-like shape. The crimping portion 22 is configured so as to, when the pair of crimp pieces 22*a* are clamped as illustrated in a state where the core wire 2 of the coaxial cable 1 is fitted between the crimp pieces, be connected to the core wire 2 of the coaxial cable 1.

The connecting portion 23 is formed as a bridging portion between the main portion 21 and the crimping portion 22.

Figure 6:
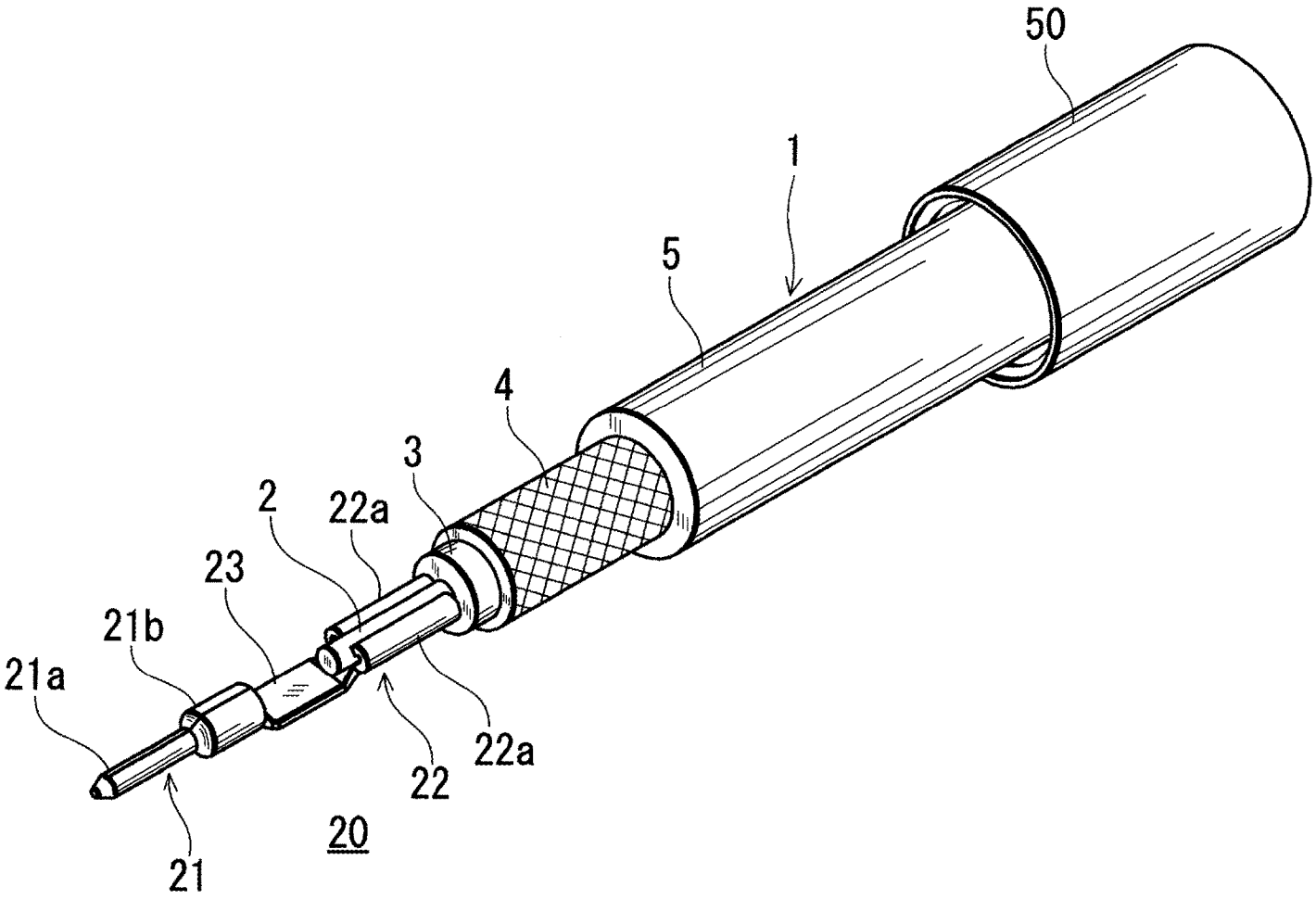
FIG. 6 is a view illustrating the method for producing the L-type coaxial connector of the embodiment, and showing an inner terminal connecting step.

Before the core wire 2 of the coaxial cable 1 is connected to the crimping portion 22, the connecting portion 23 is formed into a flat strip-like shape which straight elongates, and which is in a developed state, and the L-type inner terminal 20 is formed into a straight shape in which the main portion 21, the connecting portion 23, and the crimping portion 22 are straight aligned (see FIG. 6).

In the straight state, a pair of peripheral wall parts of the main portion 21, and the pair of crimp pieces 22*a* of the crimping portion 22 are alignedly projected toward the side of one plate surface of the connecting portion 23. After the core wire 2 of the coaxial cable 1 is connected to the crimping portion 22, L-bending (90 degrees) is applied to the flat strip-shaped connecting portion 23 which straight elongates, and which is in the developed state, while placing the main portion 21 and the crimping portion 22 inside the bent part. As a result, the L-type inner terminal 20 is formed in which the connecting portion 23 is configured by a strip-shaped piece that is bent into an L-like shape which connects the main portion 21 and the crimping portion 22 to each other in a state where the elongating direction of the main portion 21 is perpendicular to that of the crimping portion 22, the main portion 21 and the crimping portion 22 are placed inside the L-shaped bent part of the connecting portion 23, and the terminal is connected to the core wire 2 of the coaxial cable 1 (see FIG. 7).

In this way, the L-type inner terminal 20 has: the tubular main portion 21 which is to be contacted with the counter inner terminal; the crimping portion 22 in which the pair of crimp pieces 22*a* to which the core wire 2 of the coaxial cable 1 is to be crimped is disposed; and the connecting portion 23 configured by the strip-shaped piece that is bent into the L-like shape that connects between the main portion 21 and the crimping portion 22 in the state where the elongating direction of the main portion 21 is perpendicular to that of the crimping portion 22. In the L-type inner terminal 20 in which the main portion 21 and the crimping portion 22 are placed inside the L-shaped bent part of the connecting portion 23, the main portion 21 and crimping portion 22 which have a low impedance are proximal to the connecting portion 23, and therefore the increase of the impedance of the connecting portion 23 can be suppressed by using the main portion 21 and crimping portion 22 which are possessed by the L-type inner terminal 20 itself.

The connecting portion 23 includes: a 90-degree arcuate bent part 23*a;* first and second planar parts 23*b,* 23*c* which straight elongate from the ends of the bent part 23*a,* respectively; a first connecting part 23*d* which connects between the first planar part 23*b* and the basal part 21*b* of the main portion 21; and a second connecting part 23*e* which connects between the second planar part 23*c* and the basal part 22*b* of the crimping portion 22. At least the bent part 23*a,* the first planar part 23*b,* and the second planar part 23*c* have a width dimension W which is substantially equal to or larger than the outer diameter dimension D of the basal part 21*b* of the main portion 21 (W≥D). According to the configuration, the surface area ratio of the connecting portion 23 which is opposed to an outer terminal that is located in the periphery of the L-type inner terminal, and that will be described later is increased, and therefore the increase of the impedance in the connecting portion 23 can be further suppressed.

Then, the L-type coaxial connector 10 will be described. As shown in FIGS. 2 and 3, the L-type coaxial connector 10 includes the L-type inner terminal 20, and is configured so as to further include: a dielectric member 30 that has a terminal attaching part 31 to which the L-type inner terminal 20 can be attached in the fitting direction from the rear side, and that surrounds and holds the L-type inner terminal 20; an outer terminal 40 which has a tubular part 41 projected in a direction in which the L-type coaxial connector 10 is fitted to the counter connector, to be fitted with a counter outer terminal of the counter connector, which further has a contact piece part 42 projected in the axial direction of the coaxial cable 1 to overlap with the braid 4 of the coaxial cable 1, in which the dielectric member 30 is attached from the rear side, and which surrounds and holds the dielectric member 30; and a ferrule 50 which is a tubular crimp member that is clamp-fixed to the overlapping part between the contact piece part 42 of the outer terminal 40 and the braid 4 of the coaxial cable 1.

The outer terminal 40 includes a cover 60 which is separately opposed to the second planar part 23*c* of the L-type inner terminal 20 in a state where the cover covers an opening part 43 that is rearward disposed in order to allow the dielectric member 30 to be attached to the interior of the outer terminal. The dielectric member 30 includes a spacer 70 which is sandwiched between the dielectric member 30 and the cover 60 of the outer terminal 40 in a state where an opening part 32 that is rearward disposed in order to attach the L-type inner terminal 20 to the terminal attaching part 31 is covered. The outer terminal is configured so that the impedance matching is performed by the distance T between the cover 60 of the outer terminal 40 and the second planar part 23*c* of the L-type inner terminal 20, and the dielectric constant of the spacer 70 of the dielectric member 30.

The cover 60 of the outer terminal 40 has: a second contact piece part 61 which is projected from one end of the cover in the axial direction of the coaxial cable 1 to overlap with the braid 4 of the coaxial cable 1; and an engaging piece 62 which is projected from the other end of the cover along the axial direction of the coaxial cable 1 to be engaged with an engaging hole 44 disposed in the side wall of the outer terminal 40. The cover is configured so as to be electrically connected and physically coupled to the outer terminal 40 by a clamping part of the ferrule 50 and the engaging hole 44.

The dielectric member 30 and the spacer 70 therefor are formed by molding different insulating synthetic resin materials, respectively. The dielectric constants of the dielectric member 30 and the spacer 70 are made different from each other so as to realize the impedance matching.

The outer terminal 40 and the cover 60 therefor are formed by pressing electrically conductive metal plates, respectively.

Then, a method for producing the L-type coaxial connector 10 will be described with reference to FIGS. 4 to 15.

Figure 4:
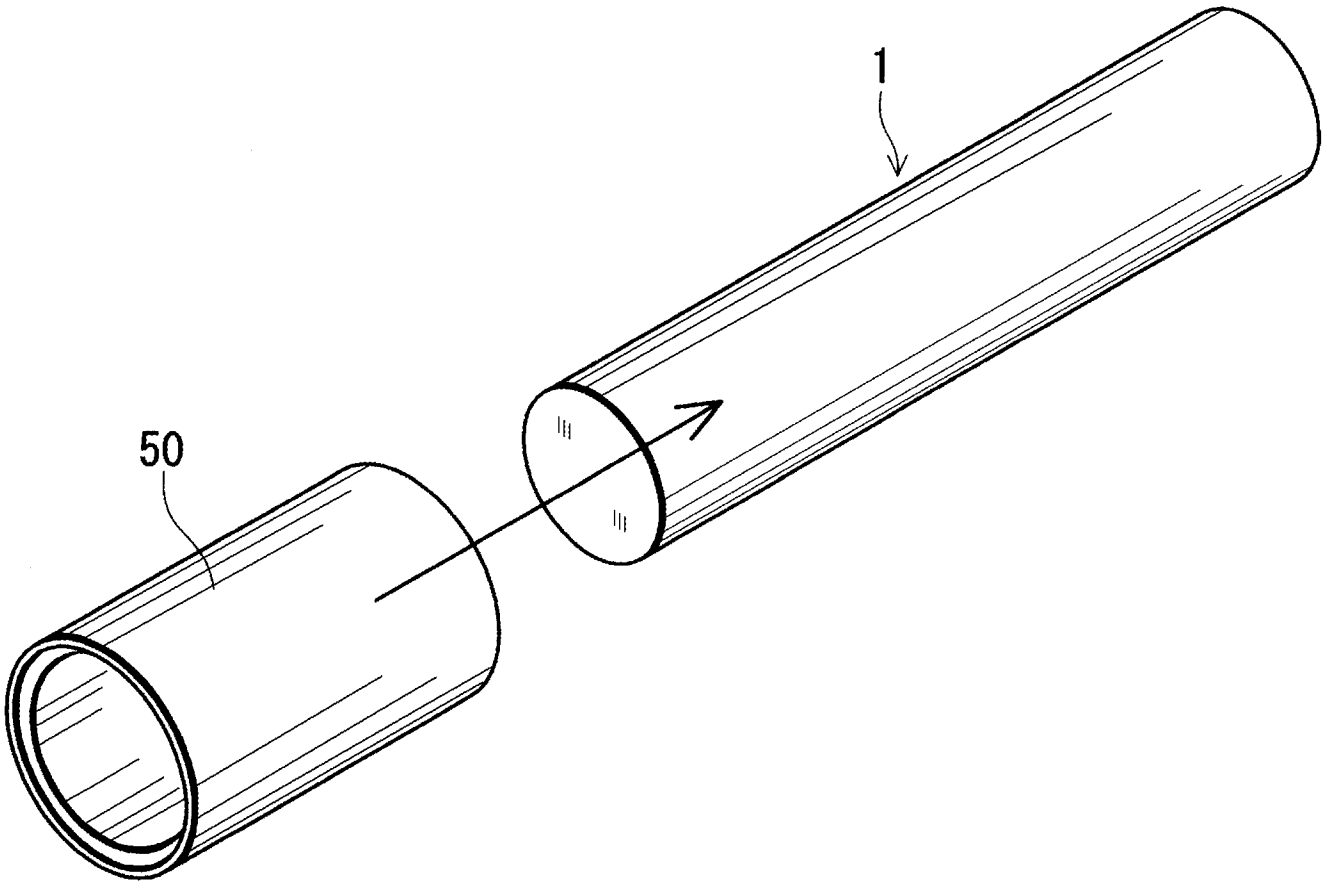
FIG. 4 is a view illustrating a method for producing the L-type coaxial connector of the embodiment, and showing a ferrule attaching step.

Regarding Ferrule Attaching Step (i.e., Initial Step):

As shown in FIG. 4, the ferrule 50 is passed over the coaxial cable 1.

Figure 5:
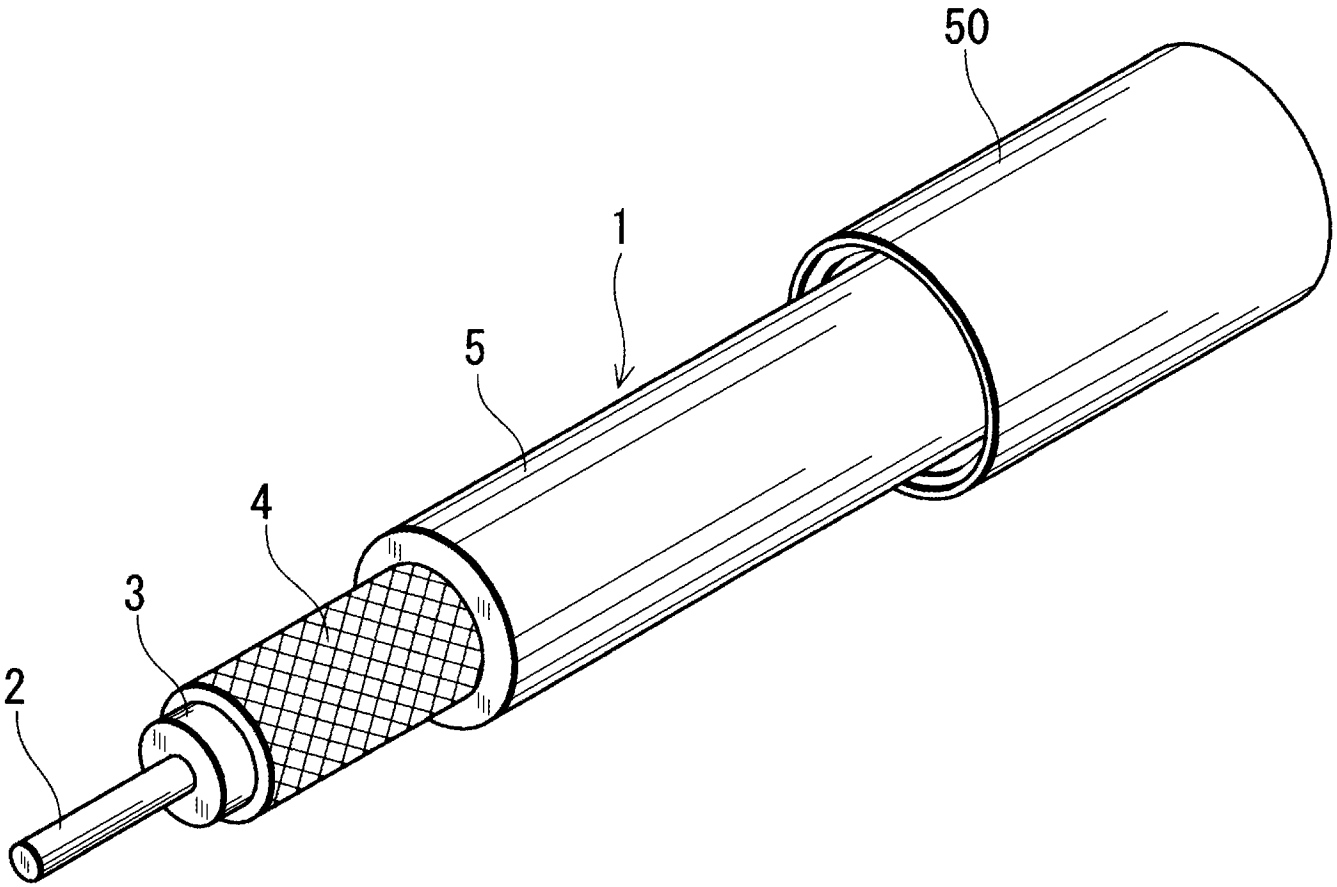
FIG. 5 is a view illustrating the method for producing the L-type coaxial connector of the embodiment, and showing a step of exposing conductors of a coaxial cable.

Regarding Conductor Exposing Step:

In the terminal of the coaxial cable 1, as shown in FIG. 5, the outer coat 5 is peeled off to expose the braid 4, and also the inner coat 3 is peeled off to expose the core wire 2.

Regarding Inner Terminal Connecting Step:

In a developed state where the connecting portion 23 of the L-type inner terminal 20 has not yet been L-bent, and straight elongates, as shown in FIG. 6, the pair of crimp pieces 22*a* of the L-type inner terminal 20 are clamped to be crimpingly connected to the core wire 2 of the coaxial cable 1.

Figure 7:
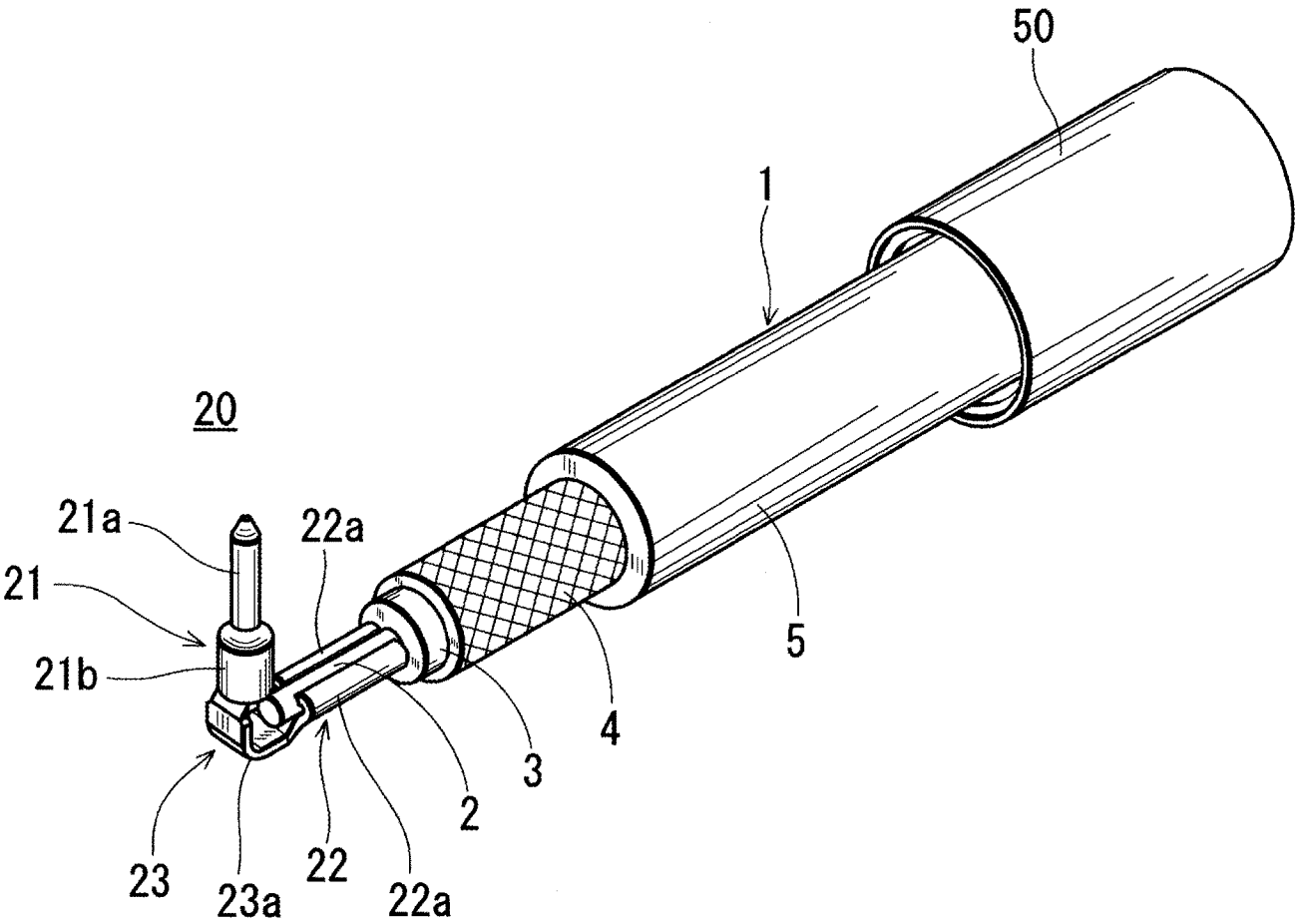
FIG. 7 is a view illustrating the method for producing the L-type coaxial connector of the embodiment, and showing a step of bending the inner terminal by 90 degrees.

Regarding Inner Terminal L-Bending Step:

As shown in FIG. 7, L-bending (90 degrees) is applied to the connecting portion 23 in a developed state while the main portion 21 of the L-type inner terminal 20, and the crimping portion which is crimped to the core wire of the coaxial cable 1 in the inner terminal connecting step are placed inside.

Figure 8:
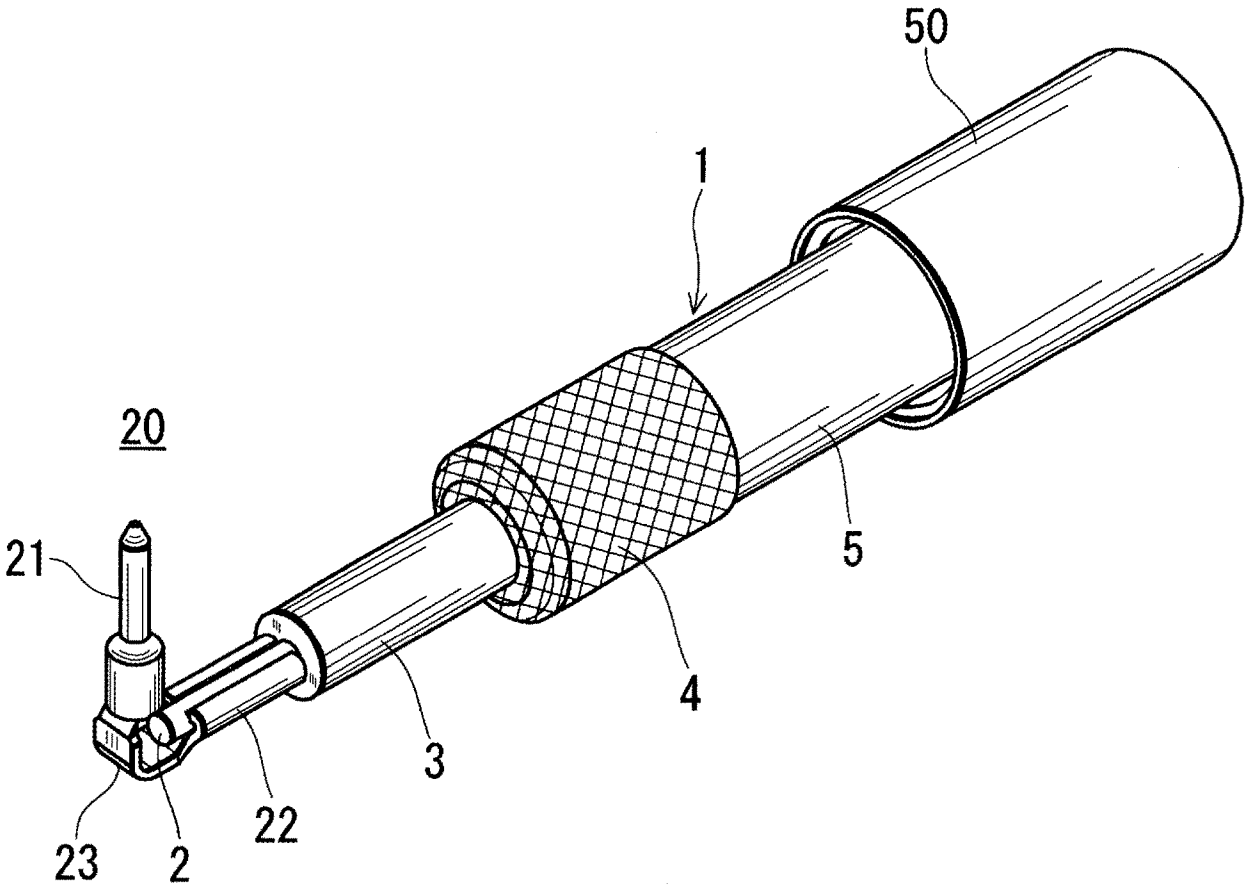
FIG. 8 is a view illustrating the method for producing the L-type coaxial connector of the embodiment, and showing a braid folding back step.

Regarding Braid Folding Back Step:

As shown in FIG. 8, the braid 4 is folded back to the outside of the outer coat 5, thereby exposing the inner coat 3.

Figure 9:
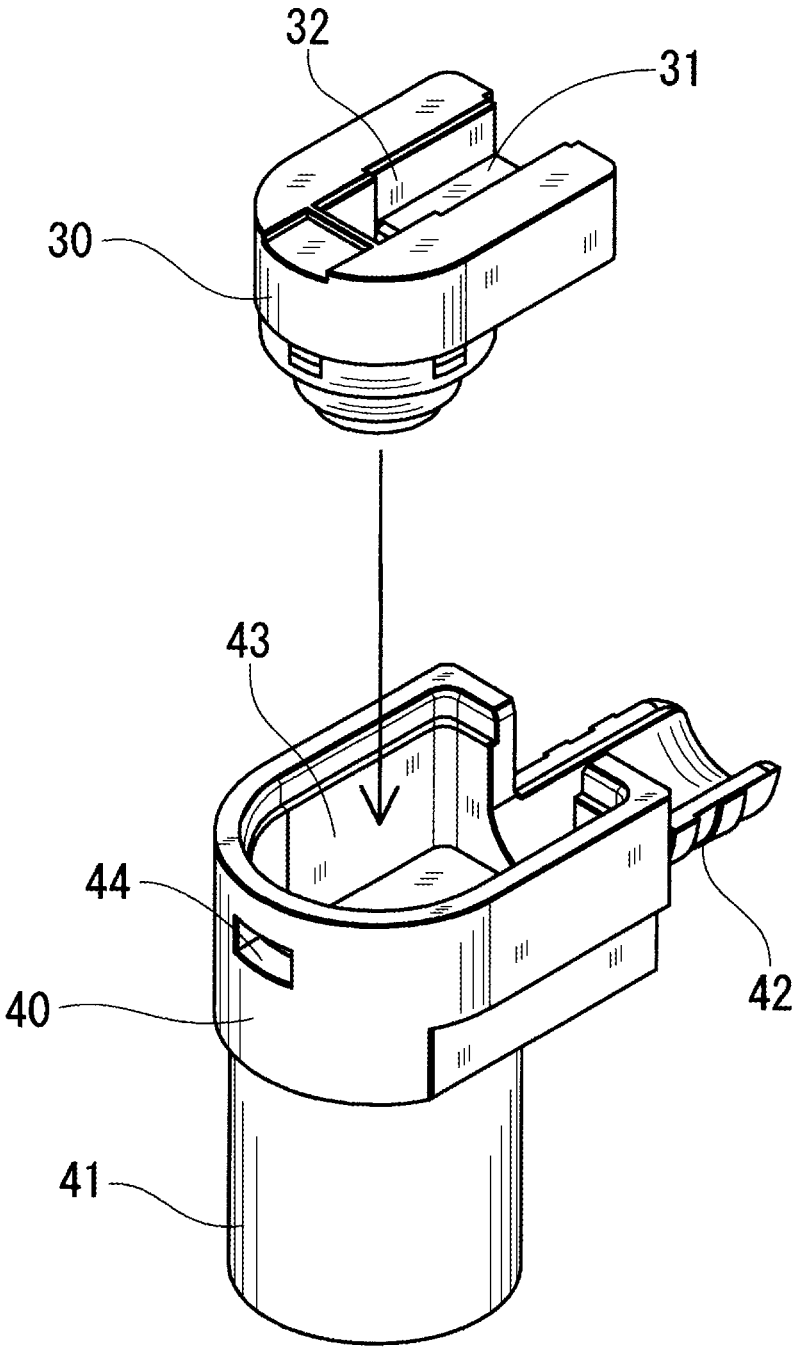
FIG. 9 is a view illustrating the method for producing the L-type coaxial connector of the embodiment, and showing a dielectric member attaching step.

Regarding Dielectric Member Attaching Step:

As shown in FIG. 9, the dielectric member 30 is press-inserted into the interior of the outer terminal 40 from the opening part 43, to be attached thereto.

Figure 10:
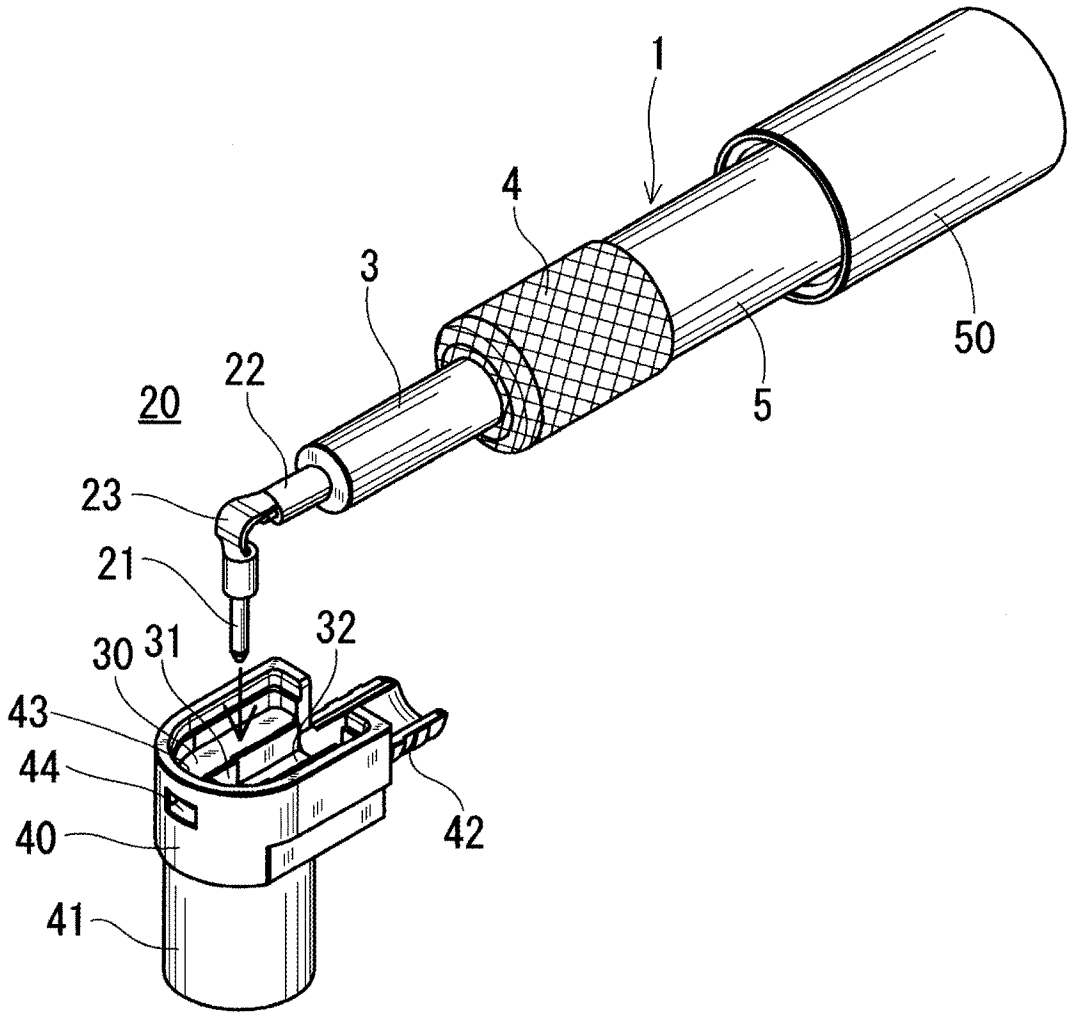
FIG. 10 is a view illustrating the method for producing the L-type coaxial connector of the embodiment, and showing an inner terminal attaching step.

Regarding Inner Terminal Attaching Step:

As shown in FIG. 10, the L-type inner terminal 20 which is connected to the core wire 2 of the coaxial cable 1 is inserted from the opening part 32 of the dielectric member 30 into the terminal attaching part 31 of the dielectric member 30 which is attached to the interior of the outer terminal 40, to be attached thereto.

Figure 11:
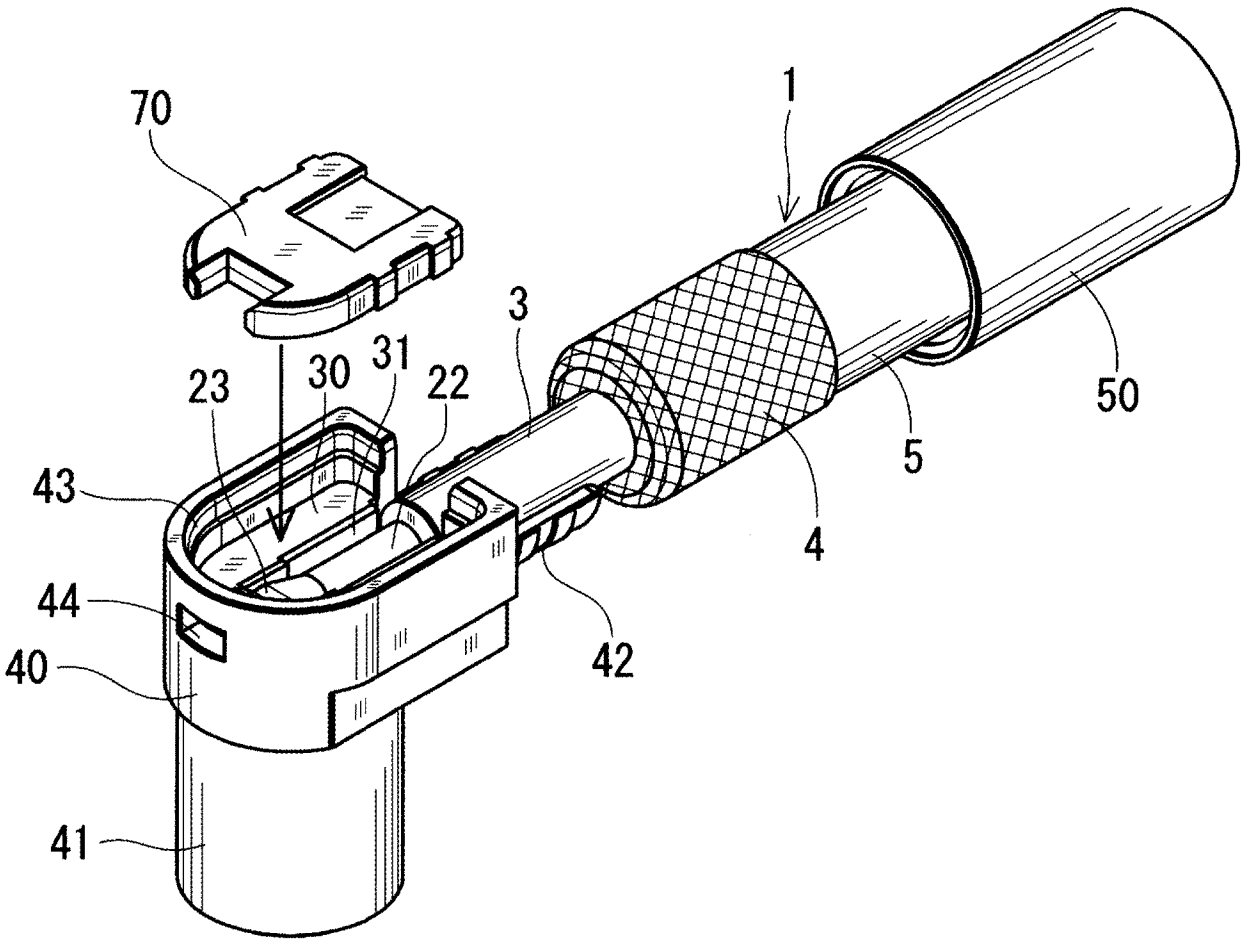
FIG. 11 is a view illustrating the method for producing the L-type coaxial connector of the embodiment, and showing a spacer attaching step.

Regarding Spacer Attaching Step:

As shown in FIG. 11, the spacer 70 is press-inserted into the rear side of the dielectric member 30 which is attached to the interior of the outer terminal 40, from the opening part 43 of the outer terminal 40, to be attached thereto.

Figure 12:
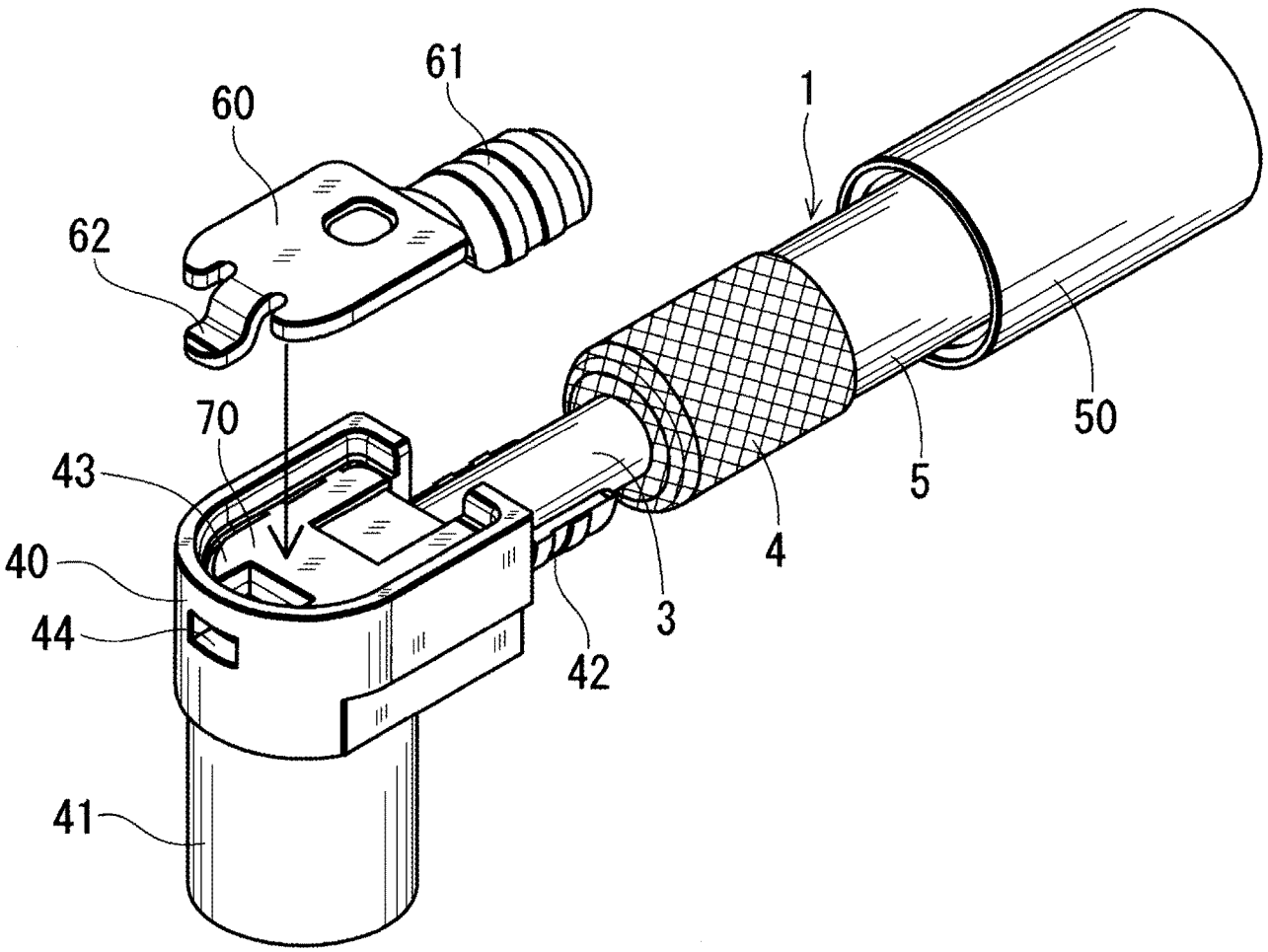
FIG. 12 is a view illustrating the method for producing the L-type coaxial connector of the embodiment, and showing a cover attaching step.

Regarding Cover Attaching Step:

In a state where the engaging piece 62 of the cover 60 is engaged with the engaging hole 44 of the outer terminal 40, as shown in FIG. 12, the cover 60 is press-inserted into the rear side of the spacer 70 which is attached to the interior of the outer terminal 40, from the opening part 43 of the outer terminal 40, to be attached thereto. As a result, the L-type inner terminal 20 is surrounded and held by the dielectric member 30 and the spacer 70, and the dielectric member 30 and the spacer 70 are surrounded and held by the outer terminal 40 and the cover 60. The semiperimeters of the exposed inner coat 3 of the coaxial cable 1 are covered by the contact piece part 42 of the outer terminal 40, and the second contact piece part 61 of the cover 60, respectively.

Figure 13:
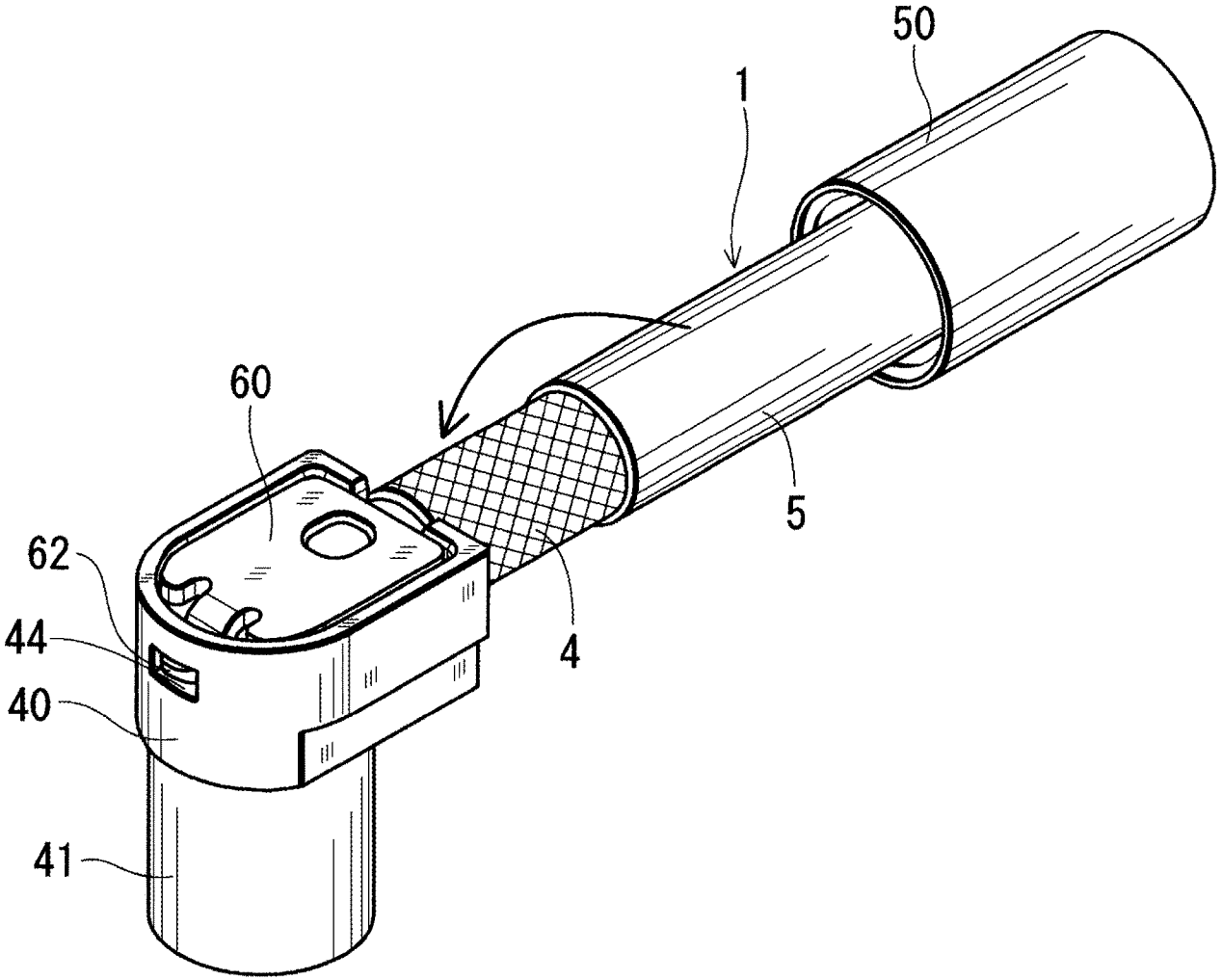
FIG. 13 is a view illustrating the method for producing the L-type coaxial connector of the embodiment, and showing a braid unfolding step.

Regarding Braid Unfolding Step:

As shown in FIG. 13, the braid 4 which is folded back to the outside of the outer coat 5 is unfolded onto the contact piece part 42 of the outer terminal 40, and the second contact piece part 61 of the cover 60, to cover them.

Figure 14:
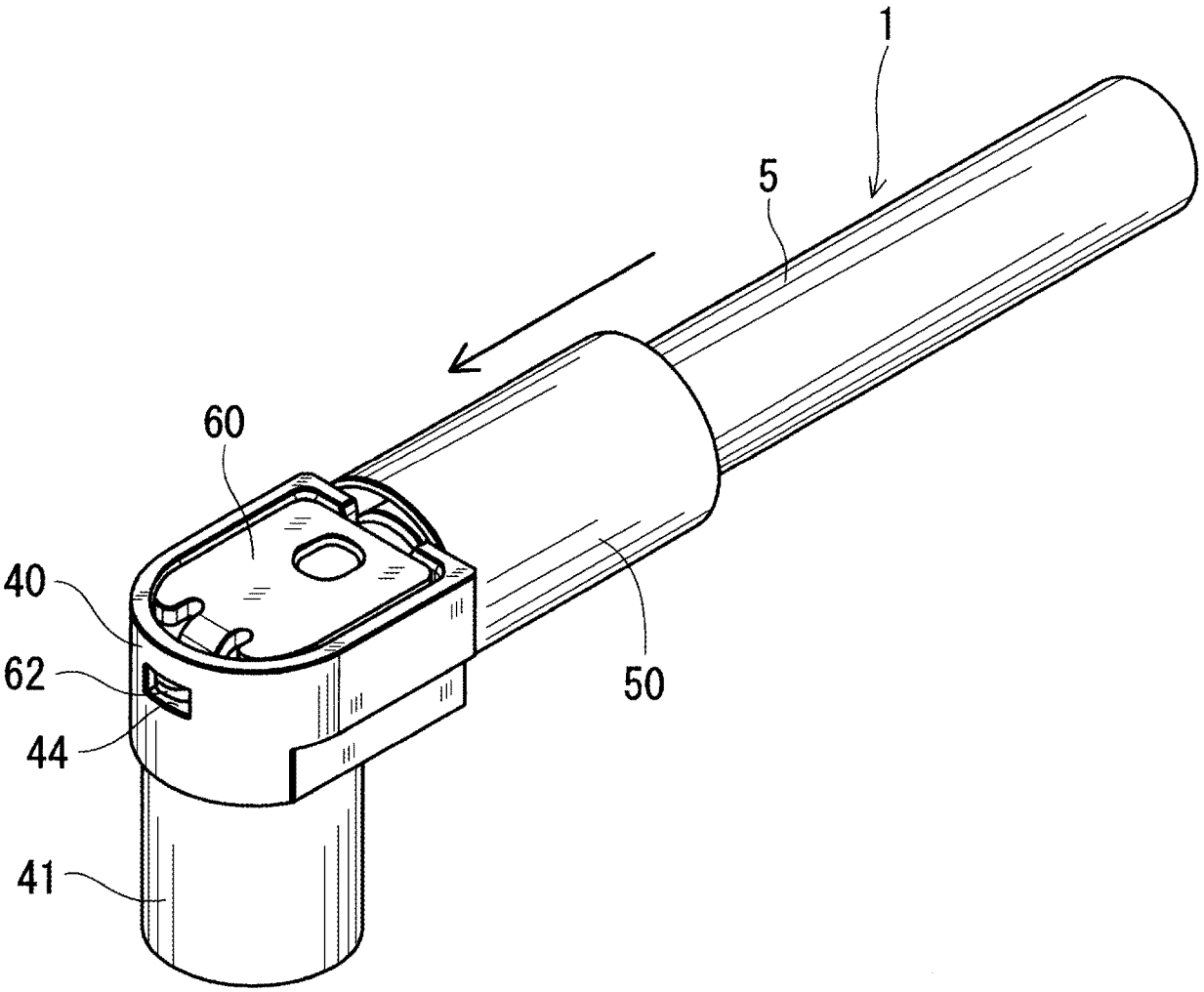
FIG. 14 is a view illustrating the method for producing the L-type coaxial connector of the embodiment, and showing a ferrule returning step.

Regarding Ferrule Returning Step:

As shown in FIG. 14, the ferrule 50 which is passed over the coaxial cable 1 is returned onto the braid 4 which covers the contact piece part 42 of the outer terminal 40, and the second contact piece part 61 of the cover 60, to cover the braid.

Figure 15:
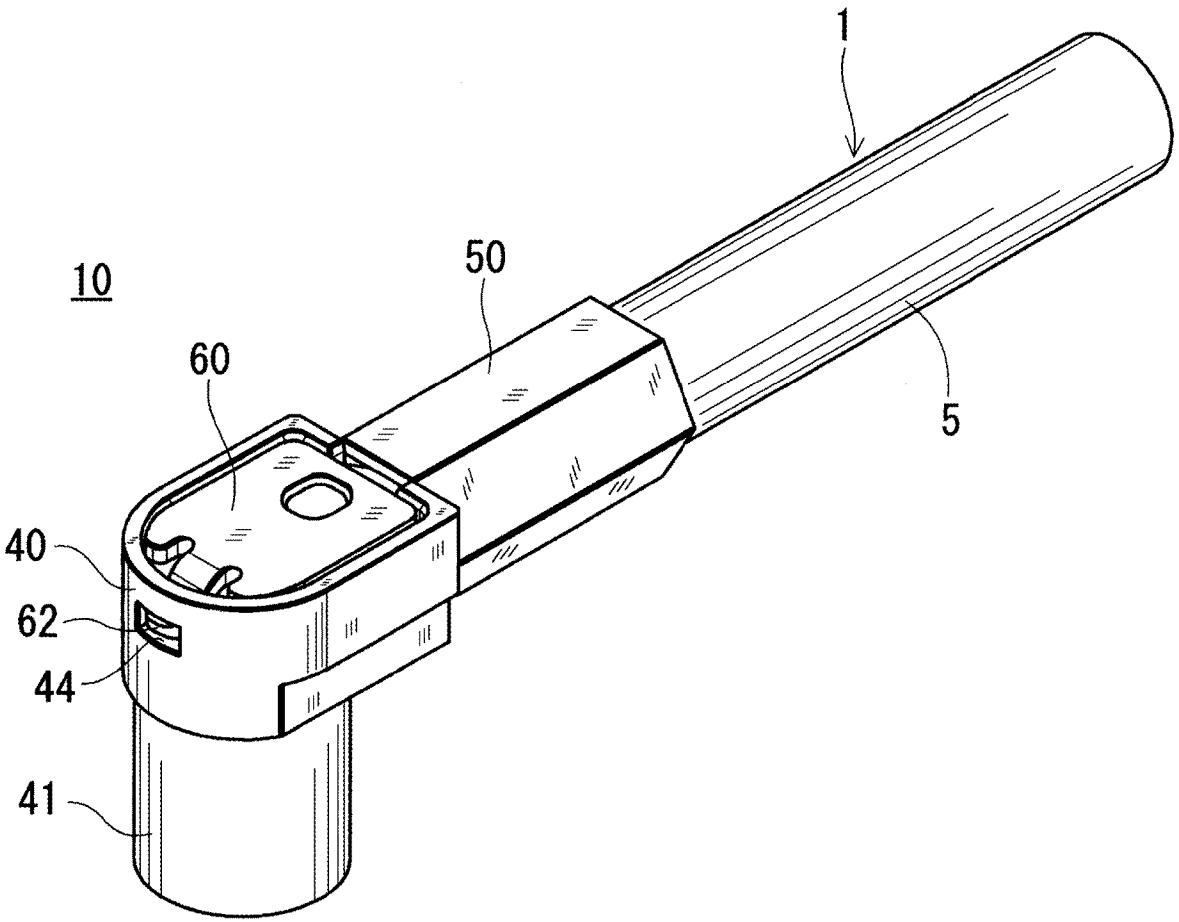
FIG. 15 is a view illustrating the method for producing the L-type coaxial connector of the embodiment, and showing a ferrule clamping step.

Regarding Ferrule Crimping Step (i.e., Final Step):

As shown in FIG. 15, the cylindrical ferrule 50 which covers the braid 4 of the coaxial cable 1 (a part of the ferrule covers the outer coat 5) is clamped into a hexagonal tubular shape, whereby the ferrule 50 is crimp-fixed to the outer circumferential sides of the braid 4 and the outer coat 5 in the terminal of the coaxial cable 1. Therefore, the braid 4 of the coaxial cable 1 is connected to the contact piece part 42 of the outer terminal 40, and the second contact piece part 61 of the cover 60, by the ferrule 50, and the outer terminal 40 and the cover 60 are made conductive with the braid 4 of the coaxial cable 1. As a result, a state where the L-type coaxial connector 10 is connected to the terminal of the coaxial cable 1 is attained (see FIG. 3).

According to the method for producing the L-type coaxial connector 10, it is possible to easily obtain the L-type coaxial connector 10 which includes the L-type inner terminal 20, and in which the increase of the impedance of the connecting portion 23 of the L-type inner terminal 20 can be suppressed.

DESCRIPTION OF REFERENCE NUMERALS

1 coaxial cable
2 core wire (inner conductor)
4 braid (outer conductor)
10 L-type coaxial connector
20 L-type inner terminal
22 crimping portion
22*a* crimp piece
21 main portion
23 connecting portion
23*a* bent part
23*b* first planar part
23*c* second planar part
23*d* first connecting part
23*e* second connecting part
30 dielectric member
31 terminal attaching part
32 opening part
40 outer terminal
41 tubular part
42 contact piece part
43 opening part
44 engaging hole
50 ferrule
60 cover
61 second contact piece part
62 engaging piece
70 spacer
D outer diameter dimension
W width dimension
T distance

What is claimed is:

1. An L-type inner terminal having: a tubular main portion which is to be contacted with a counter inner terminal; a crimping portion in which a crimp piece for crimping an inner conductor of a coaxial cable is disposed; and a connecting portion configured by a strip-shaped piece that is bent into an L-like shape which connects between the main portion and the crimping portion in a state where an elongating direction of the main portion is perpendicular to an elongating direction of the crimping portion, wherein the main portion and the crimping portion are placed inside an L-shaped bent part of the connecting portion.

2. An L-type coaxial connector which is to be attached to a terminal of a coaxial cable, and in which a fitting direction with respect to a counter connector is perpendicular to an axial direction of the coaxial cable, wherein the L-type coaxial connector comprises: the L-type inner terminal according to claim 1; a dielectric member that has a terminal attaching part to which the L-type inner terminal is attachable from a rear side toward a front side, and that surrounds and holds the L-type inner terminal; an outer terminal which has a tubular part projected in a direction in which the L-type coaxial connector is fitted to the counter connector, to be fitted with a counter outer terminal, which further has a contact piece part projected in the axial direction of the coaxial cable to overlap with an outer conductor of the coaxial cable, in which the dielectric member is attached from the rear side toward the front side, and which surrounds and holds the dielectric member; and a tubular crimp member that is clamp-fixed to an overlapping part between the contact piece part of the outer terminal and the outer conductor of the coaxial cable.

3. A method for producing the L-type coaxial connector according to claim 2, wherein the method comprises: an inner terminal connecting step of, in a developed state where the connecting portion of the L-type inner terminal has not yet been L-bent, and straight elongates, clamping the crimp piece of the L-type inner terminal to crimpingly connect the crimp piece to the inner conductor of the coaxial cable; and an inner terminal L-bending step of applying L-bending to the connecting portion in a developed state while the main portion of the L-type inner terminal, and the crimping portion which is crimped to the inner conductor of the coaxial cable in the inner terminal connecting step are placed inside.

4. The L-type coaxial connector according to claim 2, wherein the outer terminal comprises a cover that is separately opposed to the second planar part of the L-type inner terminal in a state where the cover covers an opening part which is rearward disposed in order to allow the dielectric member to be attached to an interior of the outer terminal, the dielectric member comprises a spacer that is sandwiched between the dielectric member and the cover of the outer terminal in a state where an opening part that is rearward disposed in order to attach the L-type inner terminal to the terminal attaching part is covered, and impedance matching is performed by a distance between the cover of the outer terminal and the second planar part of the L-type inner terminal, and a dielectric constant of the spacer of the dielectric member.

5. A method for producing the L-type coaxial connector according to claim 4, wherein the method comprises: an inner terminal connecting step of, in a developed state where the connecting portion of the L-type inner terminal has not yet been L-bent, and straight elongates, clamping the crimp piece of the L-type inner terminal to crimpingly connect the crimp piece to the inner conductor of the coaxial cable; and an inner terminal L-bending step of applying L-bending to the connecting portion in a developed state while the main portion of the L-type inner terminal, and the crimping portion which is crimped to the inner conductor of the coaxial cable in the inner terminal connecting step are placed inside.

6. The L-type coaxial connector according to claim 4, wherein the cover of the outer terminal has: a second contact piece part that is projected from one end of the cover in the axial direction of the coaxial cable to overlap with the outer conductor of the coaxial cable; and an engaging piece that is projected from another end of the cover along the axial direction of the coaxial cable to be engaged with an engaging hole disposed in a side wall of the outer terminal, and is electrically connected and physically coupled to the outer terminal by a clamping part of the crimp member and the engaging hole.

7. A method for producing the L-type coaxial connector according to claim 6, wherein the method comprises: an inner terminal connecting step of, in a developed state where the connecting portion of the L-type inner terminal has not yet been L-bent, and straight elongates, clamping the crimp piece of the L-type inner terminal to crimpingly connect the crimp piece to the inner conductor of the coaxial cable; and an inner terminal L-bending step of applying L-bending to the connecting portion in a developed state while the main portion of the L-type inner terminal, and the crimping portion which is crimped to the inner conductor of the coaxial cable in the inner terminal connecting step are placed inside.

8. The L-type inner terminal according to claim 1, wherein the connecting portion comprises: a 90-degree arcuate bent part; first and second planar parts which straight elongate from ends of the bent part, respectively; a first connecting part which connects between the first planar part and the main portion; and a second connecting part which connects between the second planar part and the crimping portion, and at least the bent part, the first planar part, and the second planar part have a width dimension which is equal to or larger than an outer diameter dimension of the main portion.

9. An L-type coaxial connector which is to be attached to a terminal of a coaxial cable, and in which a fitting direction with respect to a counter connector is perpendicular to an axial direction of the coaxial cable, wherein the L-type coaxial connector comprises: the L-type inner terminal according to claim 8; a dielectric member that has a terminal attaching part to which the L-type inner terminal is attachable from a rear side toward a front side, and that surrounds and holds the L-type inner terminal; an outer terminal which has a tubular part projected in a direction in which the L-type coaxial connector is fitted to the counter connector, to be fitted with a counter outer terminal, which further has a contact piece part projected in the axial direction of the coaxial cable to overlap with an outer conductor of the coaxial cable, in which the dielectric member is attached from the rear side toward the front side, and which surrounds and holds the dielectric member; and a tubular crimp member that is clamp-fixed to an overlapping part between the contact piece part of the outer terminal and the outer conductor of the coaxial cable.

10. A method for producing the L-type coaxial connector according to claim 9, wherein the method comprises: an inner terminal connecting step of, in a developed state where the connecting portion of the L-type inner terminal has not yet been L-bent, and straight elongates, clamping the crimp piece of the L-type inner terminal to crimpingly connect the crimp piece to the inner conductor of the coaxial cable; and an inner terminal L-bending step of applying L-bending to the connecting portion in a developed state while the main portion of the L-type inner terminal, and the crimping portion which is crimped to the inner conductor of the coaxial cable in the inner terminal connecting step are placed inside.

11. The L-type coaxial connector according to claim 9, wherein the outer terminal comprises a cover that is separately opposed to the second planar part of the L-type inner terminal in a state where the cover covers an opening part which is rearward disposed in order to allow the dielectric member to be attached to an interior of the outer terminal, the dielectric member comprises a spacer that is sandwiched between the dielectric member and the cover of the outer terminal in a state where an opening part that is rearward disposed in order to attach the L-type inner terminal to the terminal attaching part is covered, and impedance matching is performed by a distance between the cover of the outer terminal and the second planar part of the L-type inner terminal, and a dielectric constant of the spacer of the dielectric member.

12. A method for producing the L-type coaxial connector according to claim 11, wherein the method comprises: an inner terminal connecting step of, in a developed state where the connecting portion of the L-type inner terminal has not yet been L-bent, and straight elongates, clamping the crimp piece of the L-type inner terminal to crimpingly connect the crimp piece to the inner conductor of the coaxial cable; and an inner terminal L-bending step of applying L-bending to the connecting portion in a developed state while the main portion of the L-type inner terminal, and the crimping portion which is crimped to the inner conductor of the coaxial cable in the inner terminal connecting step are placed inside.

13. The L-type coaxial connector according to claim 11, wherein the cover of the outer terminal has: a second contact piece part that is projected from one end of the cover in the axial direction of the coaxial cable to overlap with the outer conductor of the coaxial cable; and an engaging piece that is projected from another end of the cover along the axial direction of the coaxial cable to be engaged with an engaging hole disposed in a side wall of the outer terminal, and is electrically connected and physically coupled to the outer terminal by a clamping part of the crimp member and the engaging hole.

14. A method for producing the L-type coaxial connector according to claim 13, wherein the method comprises: an inner terminal connecting step of, in a developed state where the connecting portion of the L-type inner terminal has not yet been L-bent, and straight elongates, clamping the crimp piece of the L-type inner terminal to crimpingly connect the crimp piece to the inner conductor of the coaxial cable; and an inner terminal L-bending step of applying L-bending to the connecting portion in a developed state while the main portion of the L-type inner terminal, and the crimping portion which is crimped to the inner conductor of the coaxial cable in the inner terminal connecting step are placed inside.

* * * * *